US007891649B2

(12) United States Patent
Sägesser

(10) Patent No.: US 7,891,649 B2
(45) Date of Patent: Feb. 22, 2011

(54) SHEET FEEDER FOR SUPPLYING A CONVEYING ARRANGEMENT WITH FOLDED SIGNATURES

(75) Inventor: Christoph Sägesser, Mägenwil (CH)

(73) Assignee: Mueller Martini Holding AG, Hergiswil (CH)

( * ) Notice: Subject to any disclaimer, the term of this patent is extended or adjusted under 35 U.S.C. 154(b) by 0 days.

(21) Appl. No.: 12/149,167

(22) Filed: Apr. 28, 2008

(65) Prior Publication Data

US 2008/0272537 A1 Nov. 6, 2008

(30) Foreign Application Priority Data

May 1, 2007 (EP) ..... 07405131

(51) Int. Cl.
*B65H 41/00* (2006.01)
*B65H 39/02* (2006.01)
*B65H 39/00* (2006.01)

(52) U.S. Cl. ..... 270/52.26; 270/52.14; 270/52.19; 270/52.2; 270/52.22; 270/52.23; 270/52.29

(58) Field of Classification Search ..... 270/52.14, 270/52.19, 52.2, 52.22, 52.23, 52.26, 52.29
See application file for complete search history.

(56) References Cited

U.S. PATENT DOCUMENTS 5,100,116 A * 3/1992 Graushar ..... 270/1.02
5,511,769 A * 4/1996 Wamsley et al. ..... 270/58.26
5,921,546 A * 7/1999 Herman ..... 271/270

FOREIGN PATENT DOCUMENTS

| | | | |
|---|---|---|---|
| DE | 30 35 497 | A1 | 4/1981 |
| DE | 198 21 022 | A1 | 12/1998 |
| DE | 197 38 920 | A1 | 3/1999 |
| DE | 19738920 | A1 * | 3/1999 |
| EP | 0 716 995 | A | 6/1996 |

OTHER PUBLICATIONS

European Search Report dated Sep. 25, 2007 issued in Priority Application No. EP 07405131.9.

* cited by examiner

*Primary Examiner*—Gene Crawford
*Assistant Examiner*—Yolanda Cumbess
(74) *Attorney, Agent, or Firm*—Venable LLP; Robert Kinberg; Justine A. Gozzi

(57) ABSTRACT

A sheet feeder for supplying a conveying device with folded signatures from a stack of folded signatures, the sheet feeder including a gripper drum. The gripper drum includes at least one gripper to individually remove respective signatures and a stopping device. The stopping device including a stop element to stop and align the signatures with the fold of the signatures in a forward direction. The sheet feeder includes an opening device to open the individual signatures, to deposit the signatures on the conveying device, and to reverse the forward direction of the signatures. The sheet feeder includes a delay element moving in the same direction as the gripper drum and at a conveying speed less than the gripper drum speed. A press-on device to press the signatures released by the gripper against the delay element and to slow down the individual signatures prior to the signatures hitting the stop element.

8 Claims, 8 Drawing Sheets

SHEET FEEDER FOR SUPPLYING A CONVEYING ARRANGEMENT WITH FOLDED SIGNATURES

CROSS-REFERENCE TO RELATED APPLICATION

This application claims the priority of European Patent Application No: 07405131.9, filed on May 1, 2007, the subject matter of which is incorporated herein by reference.

BACKGROUND OF THE INVENTION

The invention relates to a sheet feeder for supplying a conveying device with folded signatures, comprising a gripper drum with at least one gripper for removing the signatures individually from a stack. In such a device, a peripherally arranged stopping device on the gripper drum includes a stop element against which the signatures can be aligned, respectively, with the fold forward. An opening mechanism opens the individual signatures aligned against the stopping device and deposits the signatures on the conveying device while also reversing their direction.

Sheet feeders of this type have long been used, for example in gathering and wire-stitching machines. These sheet feeders use a gripper drum to pull folded signatures individually from a stack, to open the signatures and deposit them, for example on a gathering chain. Sheet feeders of this type must meet the requirement of ensuring a trouble-free deposit of the signatures, even if different formats and different types of paper are used.

One essential parameter which limits the production speed is the speed at which the signature impacts the stop element. The impact causes a compressing and buckling of the signatures, especially with thin signatures, or causes the signatures to rebound from the stop element, which causes problems when the signatures are opened with the aid of the opening drums. This problem has long been known and several solutions have already been proposed.

German patent document DE-A-30 35 497 discloses a sheet feeder of the aforementioned type, which is embodied with a movable stop element. The stop element respectively takes over the signatures with a synchronous movement and then slows the signatures down, which is designed to prevent a compressing of the signatures that arrive at high speed at the stop element.

German patent document DE-A-197 38 920 discloses a sheet feeder having a belt arranged upstream of the stop element, which forms a wedge-shaped intake opening for the signatures. The goal is to achieve a stabilization of the signatures during the impact with the end stop by using the friction between the signatures and the belt.

European patent document EP-A-0 716 995 discloses a sheet feeder, for which a guide arrangement that is connected to a stop element for signatures is automatically adjusted and displaced by the supplied signature and for which the stop element itself is made of rubber or a rubber mixture that dampens the impact of the signature.

Especially with heavy signatures, it is difficult even with the aforementioned, proposed devices to sufficiently reduce the kinetic energy at high speeds when the signatures impact with the stop elements, to prevent excessive deformations that would interfere with the further processing.

SUMMARY

The above and other objects are accomplished according to one aspect of the invention wherein there is provided a sheet feeder for supplying a conveying device with folded signatures from a stack of folded signatures, the sheet feeder comprising gripper drum including at least one gripper to individually remove respective signatures from the stack; a stopping device including a stop element peripherally positioned on the gripper drum to stop the signatures and to align the signatures with the fold of the signatures in a forward direction; an opening device to open the individual signatures, to deposit the signatures on the conveying device, and to reverse the forward direction of the signatures; a delay element moving in the same direction as the gripper drum and at a conveying speed less than a speed of the gripper drum; and a press-on device arranged upstream of the stop element to press the signatures released by the gripper against the delay element and to slow down the individual signatures upstream of the stop element to an approximate speed of the delay element prior to the signatures hitting the stop element.

With the sheet feeder according to the invention, the speed of the signatures is therefore reduced gradually through the transfer to a delay element with substantially lower speed. As a result, the signatures can be slowed down, for example to half the peripheral speed of the gripper drum. Upon impact with the stop element, the signatures in that case move at only half the speed and can be controlled more securely. In particular thin signatures can thus be processed at high capacity without the signatures being compressed noticeably at the stop element. Thick and heavy signatures, which have correspondingly high kinetic energy, can be controlled easier.

A press-on device according to one modified embodiment of the invention is arranged on the stopping device itself, thus providing a simple and yet stable support for these press-on devices. The press-on devices simultaneously stabilize the signatures in the area of the stopping device.

The press-on device may comprise at least one press wheel which fits against one outside of the delay element. This press wheel presses the individual signatures against the outside of the delay element, just prior to the impact, thereby considerably reducing the conveying speed of the signatures. Two press wheels, arranged at a distance to each other, may be provided to allow for a broad and secure support and stabilization of the signatures when these impact with the stop element.

The press-on device according to a different modification of the invention may be arranged on one arm of the stopping device and pressed with tension against the delay element, wherein the tension may be adjustable. The signatures can thus be slowed down securely to the lower conveying speed.

The delay element according to a different modification of the invention is driven by the gripper drum, which can be realized particularly easily from a structural point of view by using a friction wheel that moves along with the gripper drum, at a distance to the axis of rotation. The friction wheel in this case can be driven with the aid of a toothed belt, which is engaged in a locally fixed belt pulley.

According to a different modification of the invention, the delay element is provided with at least one ring positioned along the periphery of the gripper drum, wherein the individual signatures are pressed against an outside surface of this ring before reaching the stop element. A particularly secure and stable slowing down of the signatures is ensured if two rings of this type are provided, which respectively have one outside surface. The radius of the outside surfaces is equal to or smaller than the radius on which the grippers transport the signatures to the stopping device.

The signatures may be gripped simultaneously by two grippers, which are respectively arranged directly adjacent to the aforementioned outside surfaces of the rings. The spacing between the outside surfaces is thus the same or insignificantly smaller than the spacing between the grippers, which are respectively arranged in pairs.

According to another modification of the invention, the delay element is provided with at least one endlessly circulating belt, which is arranged at the very least in the region of the stopping device and is driven with a speed that is considerably lower than the conveying speed of the aforementioned grippers.

According to yet another modified embodiment of the invention, the signatures can be slowed down to an especially low conveying speed if the delay element is provided with two or more than two members that operate at different conveying speeds. The signatures can thus be slowed over the course of two or more stages to an especially low speed. As a result, the speed at which the signatures impact with the stop element can be reduced even further and thus also the danger of damage to the signatures.

The sheet feeder is particularly suitable as a feeder for a gathering chain, but other conveying devices can also be equipped with a sheet feeder of this type.

BRIEF DESCRIPTION OF THE DRAWINGS

The present invention will be more readily understood from the following detailed description when read in conjunction with the accompanying drawings, in which.

DETAILED DESCRIPTION

Figure 1:
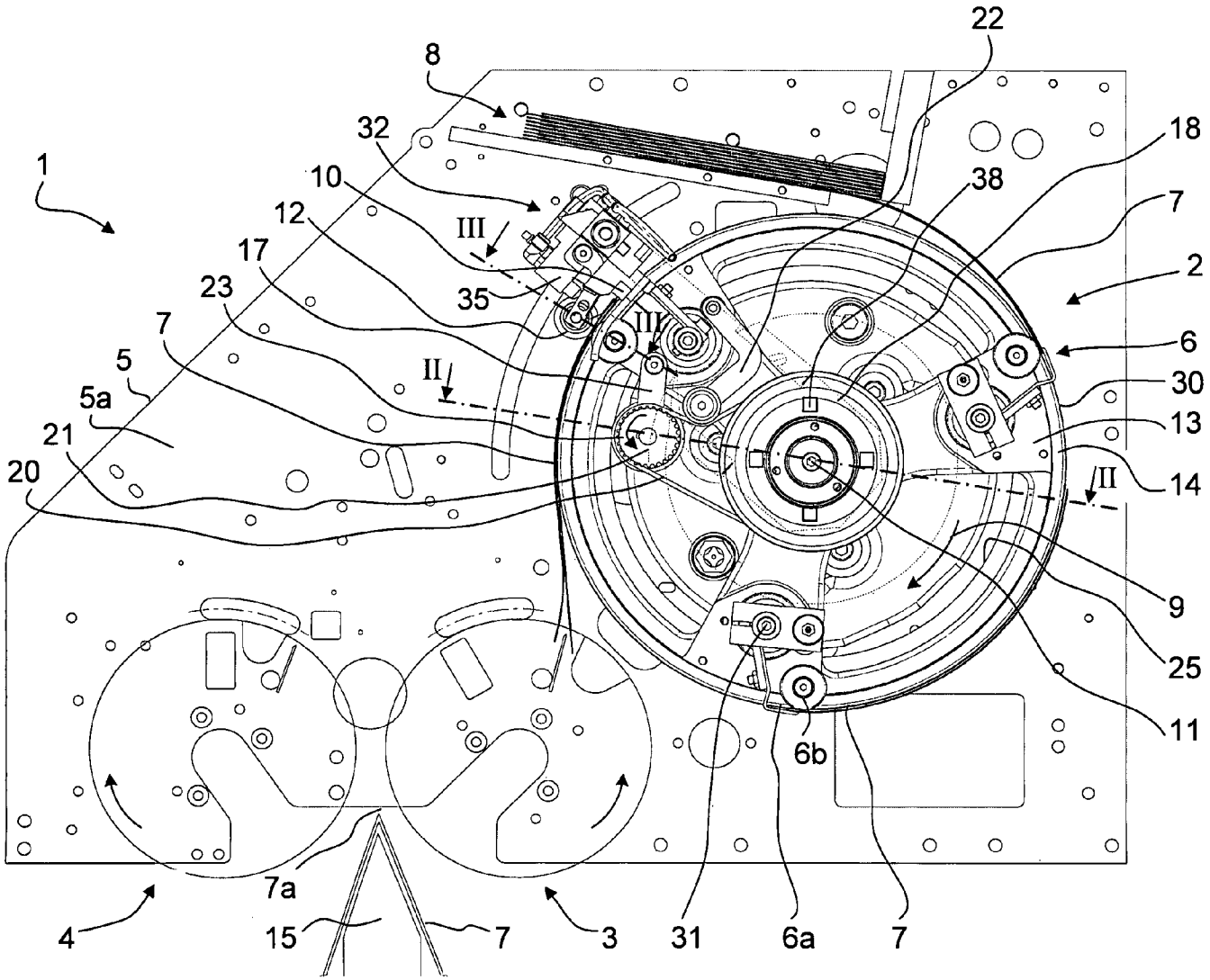
FIG. 1 A view from the side of a sheet feeder according to the invention, wherein one side wall of the housing is omitted for drawing reasons.

The sheet feeder 1 shown in FIG. 1 comprises a housing 5, provided with side plates 5*a* arranged at a distance to each other, of which only one is shown in FIG. 1. A so-called A-shaft 2 is positioned inside the housing 5, which for the present embodiment is driven in the direction of arrow 9 and thus clockwise around an axis of rotation 11 with the aid of a drive that is not shown herein. With the A-shaft 2, a separate folded signature 7 is respectively pulled from a stack 8, which can also be arranged inside the housing 5, and is conveyed with the fold 7*a* facing forward in the direction of arrow 9 toward a stopping device 32. The stopping device 32 is adjusted to the format of a signature 7 and, together with a stop element 10, forms an end stop for the individual folded signatures 7. The signatures 7, which rest with the fold 7*a* against the stop element 10, are gripped by a B-shaft 3 and a C-shaft 4 and are opened in a manner known per se and deposited onto a conveying device, for example a gathering chain 15. The signatures 7, which are deposited saddle-shaped on the gathering chain 15, are conveyed parallel to the axis of rotation 11 and are supplied to other devices, not shown herein, for further processing. The B-shaft 3 and the C-shaft 4 can be embodied in a manner known per se and will therefore not be explained further herein. These shafts can furthermore be replaced by a different, suitable device for opening the signatures 7 and depositing these on a conveying device.

Figure 2:
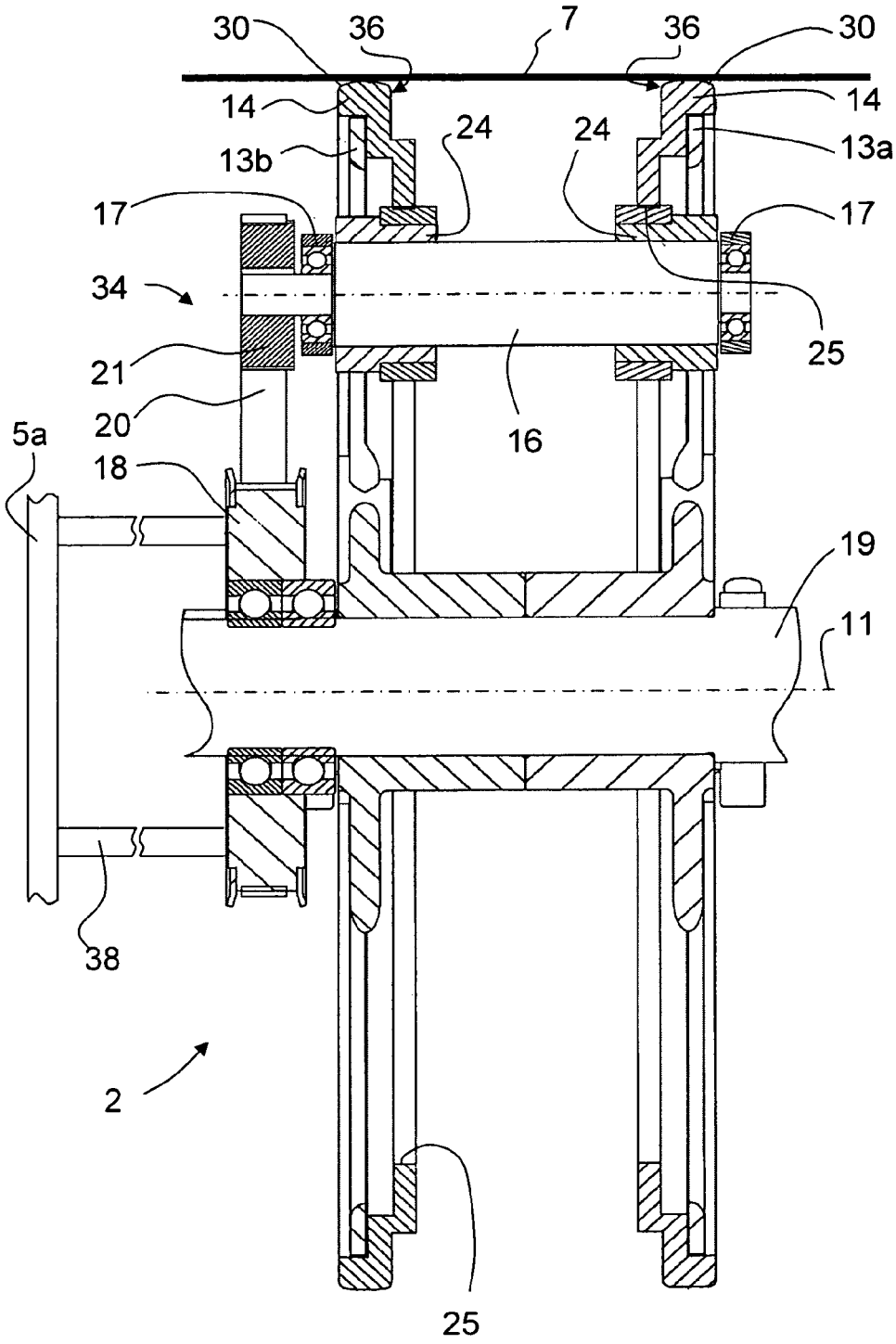
FIG. 2 A section through the sheet feeder, along the line II-II in FIG. 1.

According to FIG. 2, a gripper drum 13 (See FIGS. 1 and 4) is provided with two wheels 13*a* and 13*b*, arranged at a distance to each other, which are fixedly connected to a shaft 19. This shaft 19 is positioned in the housing 5 and is driven with the aid of a toothed belt 37. Three grippers 6, each consisting of a gripper arm 6*a* and a gripper support 6*b*, are positioned uniformly spaced apart along the periphery of each of the two wheels 13*a* and 13*b*. The grippers 6 are arranged in pairs, for example on the outside, meaning they are at a greater distance in the direction of the axis of rotation 11 than the two wheels 13*a* and 13*b*. However, it is also conceivable to arrange the grippers 6 of at least one of the wheels 13*a* and/or 13*b* between the wheels 13*a* and 13*b*. The gripper arms 6*a* are respectively attached to a control shaft 31, which is connected to control cams arranged inside a housing 33 (See FIG. 4), and can be pivoted with the aid of this control shaft for gripping respectively one signature 7 in a manner known per se.

Figure 4:
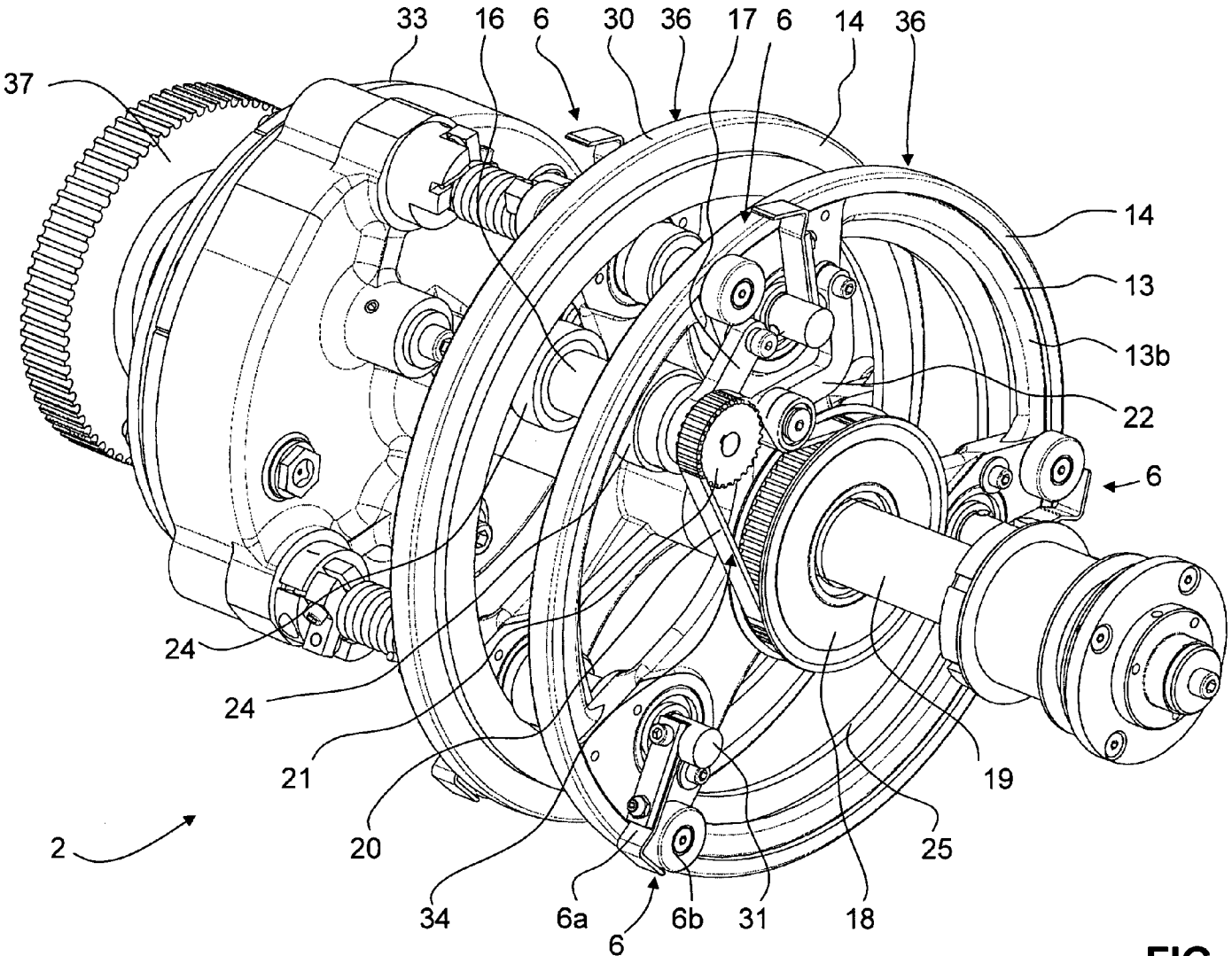
FIG. 4 A three-dimensional view of a part of the sheet feeder according to the invention.

Two opened grippers 6 are shown at the top of FIG. 4 while the remaining grippers 6 are closed. As shown in FIG. 1, a signature 7 is gripped and held along the fold 7*a* by respectively two gripper arms 6*a* and two gripper supports 6*b* in the closed state. Three signatures 7 per rotation can be transported with the gripper drum 13. The gripper drum 13 can also be embodied such that it can transport only one signature 7 per rotation or more than three signatures 7 per rotation. The arrangement of grippers 6 shown herein only represents one embodiment of the gripping means.

Figure 3:
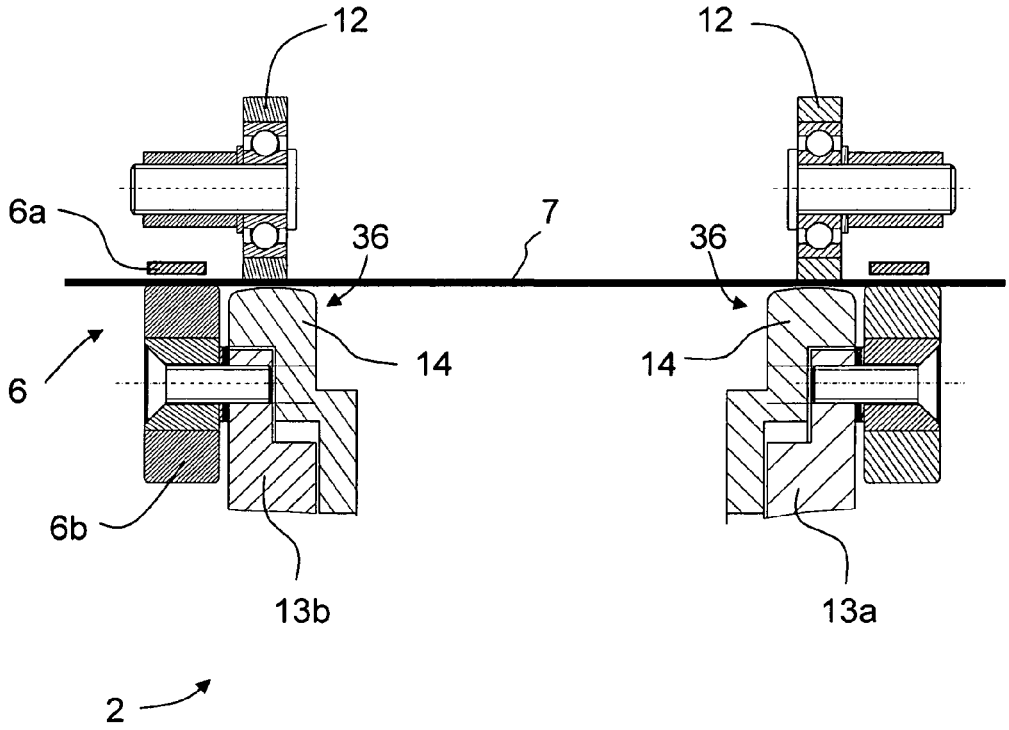
FIG. 3 A section through the sheet feeder, along the line III-III.

Each wheel 13*a* and 13*b* is provided with respectively one ring 14, driven with the aid of a drive 34 (See FIG. 2). The two rings 14 are driven with a peripheral speed that is considerably less than the speed of the gripper drum 13. The peripheral speed of the two rings 14, for example, is half the peripheral speed of the gripper drum 13. FIG. 3 shows that the outside diameter of the rings 14 is selected to be the same or smaller than the diameter for the rotation of the grippers 6 gripping the signatures 7 when these rotate around the axis of rotation 11.

The drive 34 comprises a belt pulley 18, which is positioned on the shaft 19 and is fixedly connected to the housing 5 with the aid of a bracket 38. The belt pulley 18 is therefore immovable, relative to the housing 5. Arranged at a distance to the shaft 19 is a different belt pulley 21 that is connected non-rotating to a shaft 16, wherein this shaft is mounted with the aid of a holder 17 on the gripper drum 13, parallel and at a distance to the shaft 19. A toothed belt 20 moving in a direction represented by the arrow 23 is fitted around the belt pulleys 18 and 21, which can be tensioned with a belt tensioning device 22. If the gripper drum 13 rotates on the shaft 19 around the axis 11, then the shaft 16 moves along a circular orbit around the axis 11, in a manner similar to a planet. As a result of the engagement of the toothed belt 20, the shaft 16 simultaneously rotates around its axis. For driving the two rings 14, two friction wheels 24 are mounted at a distance to each other on the shaft 16, wherein FIG. 2 shows that the friction wheels are respectively pressed against an inside surface 25 of the rings 14.

The peripheral speed and the rotational direction of the rings 14 can be influenced by correspondingly selecting the transmission ratio of the pulleys 18 and 21, as well as the diameter of the friction wheels 24 and the inside diameter of the inside surface 25 of the rings 14. For example, the transmission ratio is preferably selected such that the peripheral speed of the two rings 14 amounts to approximately 20 to 40% of the peripheral speed of the gripper drum 13. In place of the frictional transfer of the rotational movement from the wheels 24 to the rings 14, a different method of transfer can also be used, for example using a toothing. Furthermore conceivable is an embodiment where the rings 14 are driven separately, for example with a suitable motor.

The individual signatures 7 that are pulled from the stack 8 are then transported preferably with a uniform conveying speed $v_1$ to the stopping device 32. Shortly before a fold 7*a* (FIG. 1) of the signature 7 impacts with the stop element 10, the respective two grippers 6 release the signature 7. Essentially at the same time as the respective grippers 6 open up, the signature 7 is pressed with two press wheels 12 against respectively one outside surface 30 of the two rings 14, as shown in FIGS. 2 and 3 respectively. As a result of the frictional contact with the outside surfaces 30, the signature 7 is slowed down to the peripheral speed $v_2$ of the two rings 14 and, in the process, loses kinetic energy. The contact pressure of the two press wheels 12 can be adjusted with an adjustment device 35 (FIG. 1) of the stopping device 32. This contact pressure can be changed, for example with the aid of a piston that is admitted with adjustable compressed air. Furthermore conceivable is a design where a spring is used to generate the desired contact pressure. The friction between the signature 7 and the outside surfaces 30 and thus also the negative acceleration of the signature 7 can be adjusted by changing the contact pressure.

The signature 7 is then conveyed further with correspondingly reduced speed, until the fold 7*a* comes to rest against the stop element 10 and the signature 7 is aligned accordingly. The stop element 10 preferably consists of a resilient material, which for the most part prevents the printed product from bouncing back. The exposed edges of the signature 7, which extend parallel to the fold 7*a*, are then gripped by the B-shaft 3 and the C-shaft 4 and the signature 7 is opened, so that it can be deposited on the gathering chain 15 as shown in FIG. 1. The direction of the signature 7 is reversed while it is pulled from the stopping device 32.

Before the signature 7 is gripped by the B-shaft 3 and the C-shaft 4 and is opened, the signature 7 is aligned with the stop element and, as a result of the frictional force, remains aligned with the stop element 10 and the two rings 14. This frictional force is overcome when the signature 7 is pulled from the stopping device 32.

The two rings 14 together with the press wheels 12 form a delay element 36 for conveying the signatures 7 in the same direction as the grippers 6, but with considerably reduced speed.

Figure 6:
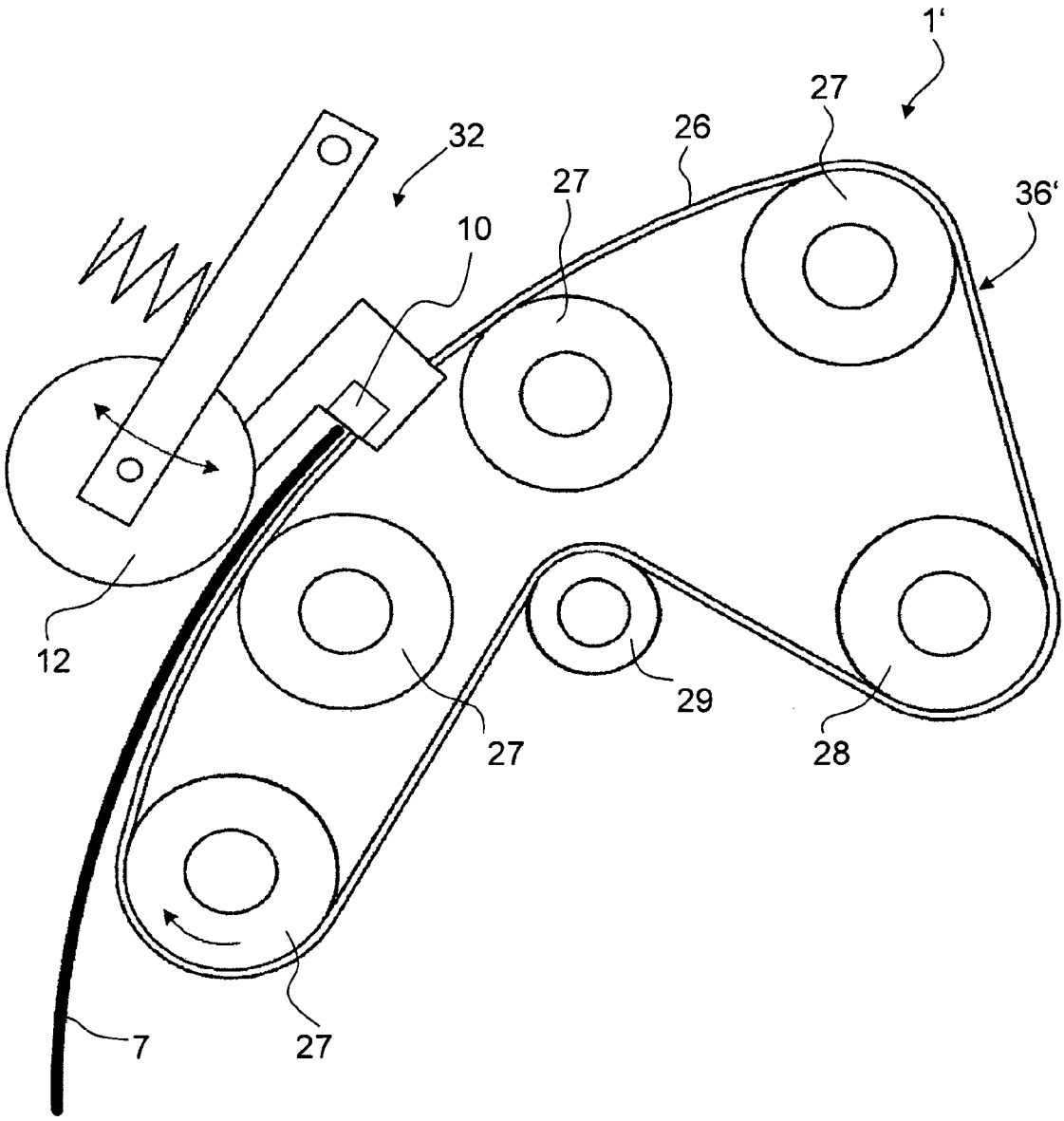
FIG. 6 A partial view of a signature stop element according to a modified embodiment.

FIG. 6 shows a sheet feeder 1', having basically the same basic design as the sheet feeder 1, but with a modified delay element 36' according to one variant. In place of the two rings 14, this embodiment comprises an endlessly rotating belt 26 that is guided over deflection rollers 27 and is driven by a drive roller 28. The belt 26 is tensioned with a tensioning roller 29. As can be seen, the belt 26 is guided along a curved path in the region of the deflection rollers 27 and extends upstream and downstream of the stop element 10. The belt 26 may be driven with a uniform speed $v_2$, wherein the speed $v_2$ corresponds to the speed of the delay element 36. The speed $v_2$ does not have to be uniform, but can also be controlled to be variable. For example, the speed $v_2$ can be controlled to drop in the direction of transport of the signatures 7 to the stop element 10, so that the speed of the signature 7 is reduced even further when it impacts with the stop element 10.

The gripper drum 13, which is not shown in FIG. 6, conveys a signature 7 that is pulled from the stack 8, as described in the above. Before hitting the stop element 10, the signature 7 is gripped by the pressure wheel 12 and is pressed against the belt 26. At the same time, the gripper 6 which has been conveying the signature 7 opens up and the signature 7 is thus transferred to the belt 26 for further conveying. In the same way as the sheet feeder 1, the conveying speed of the signature 7 is reduced as a result of the lower conveying speed of the belt 26. A gradual delay over several stages is also possible with the sheet feeder 1', wherein several belts 26 and press wheels 12 would then be provided. The gripping of the signatures 7 with the B-shaft 3 and the C-shaft 4 as well as the depositing on the gathering chain 15 and/or the conveying device takes place as explained in the above.

Figure 7:
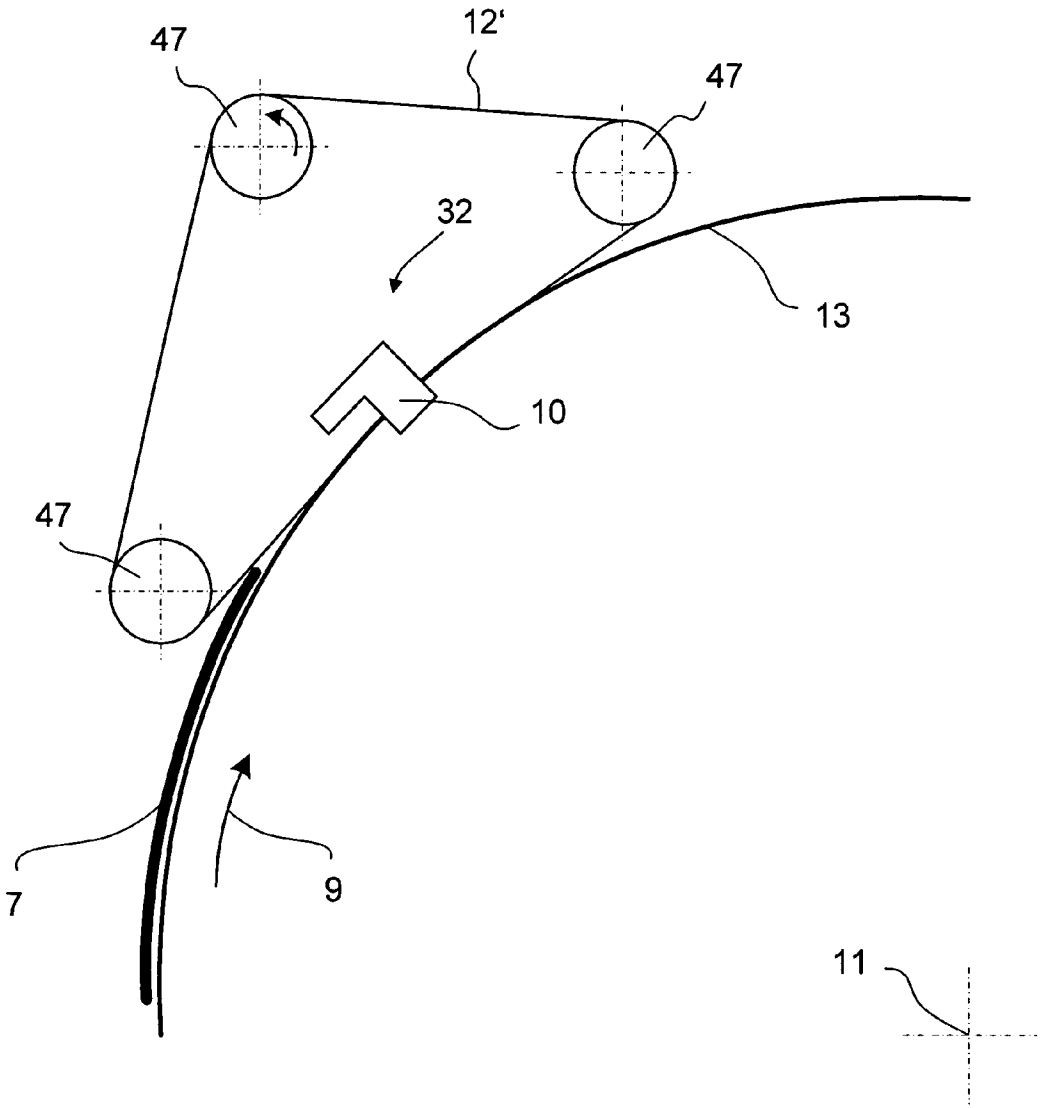
FIG. 7 A partial view of a signature stop element according to a another modified embodiment.

A different suitable press-on element, e.g. an endlessly circulating belt 12' that is guided over deflection rollers 47 as shown in FIG. 7, can also be provided in place of the press wheel 12. Also possible is an embodiment with two belts 26, arranged at a distance to each other, and correspondingly two press wheels 12. In that case, the signatures 7 are gripped accordingly by two belts 26 and two press wheels 12 and are conveyed to the stop element 10.

Figure 5:
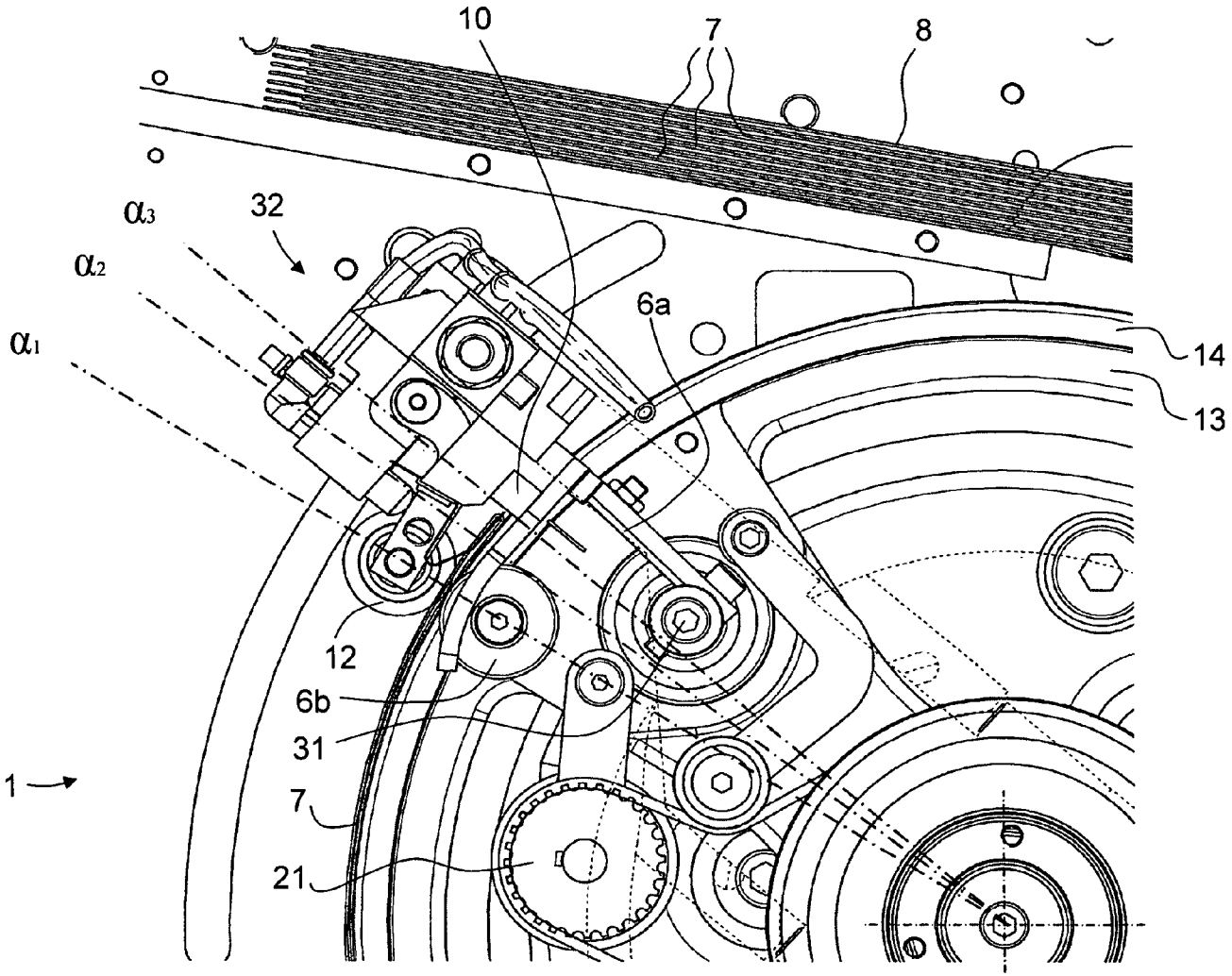
FIG. 5 A partial view of the sheet feeder according to the invention.

The course of the speed during the transport of the signature 7 in the region of the stopping device 32 is explained in further detail in the following with the aid of the diagram shown in FIG. 8 and the representation according to FIG. 5. FIG. 5 shows a first angle position $\alpha_1$ at which the gripper 6 opens up, which grips the signature 7. At the angle $\alpha_1$ the respective signature 7 is pressed against the rings 14, essentially at the same time as the grippers 6 open up, thus reducing the signature 7 speed $v_1$ to the speed $v_2$, as shown with the example of a curve K2 in FIG. 8. While traveling from the angle position $\alpha_1$ with peripheral speed $v_1$, the respective signature 7 is slowed down to the peripheral and/or conveying speed $v_2$ by the time it reaches a second angle position $\alpha_2$. At the angle position $\alpha_3$, the signature 7 hits the stop element 10 with the fold 7*a* facing forward and is slowed by this element to the peripheral speed $v_0$ and thus to zero speed.

Figure 8:
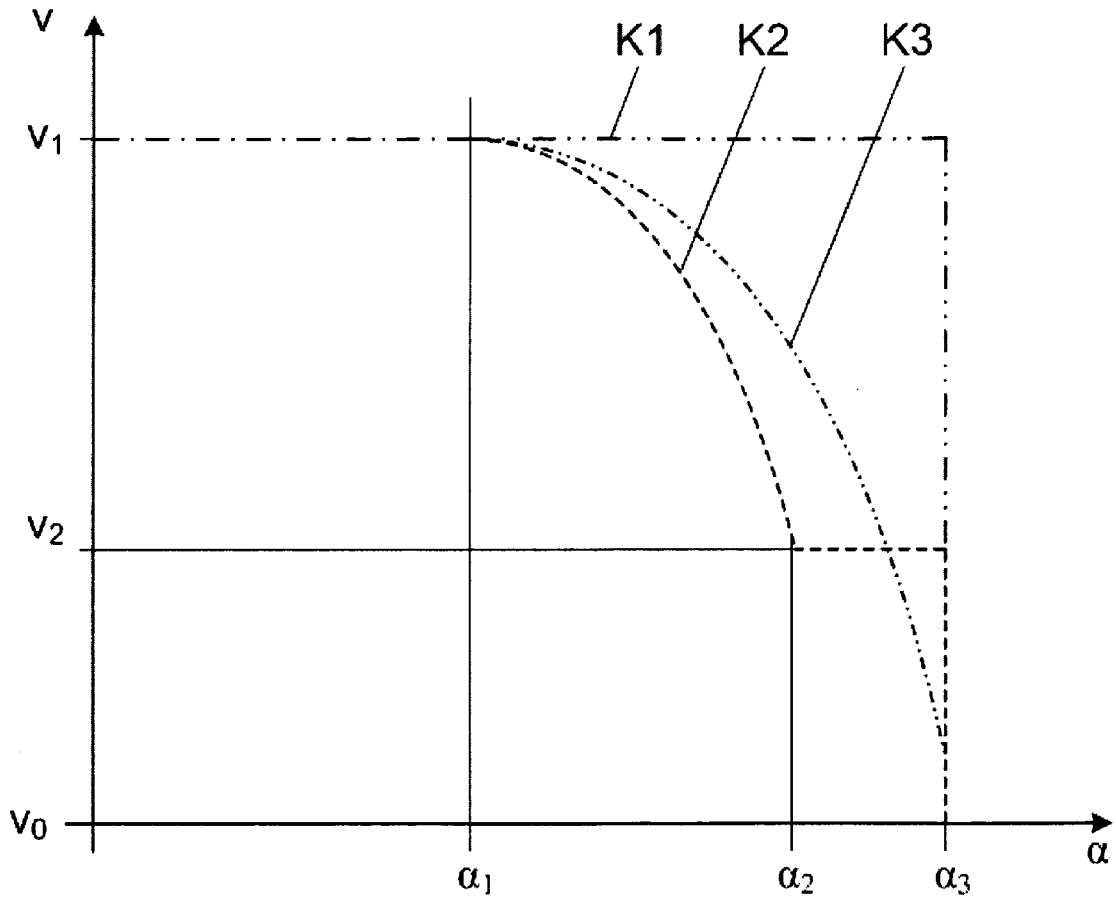
FIG. 8 A diagram, which explains the changes in the speed of the signature while it is conveyed on the gripper drum.

The curve K3 in FIG. 8 represents the speed course for a signature 7, which is conveyed with the aid of a delay element 36 and/or 36', for which the speed is controlled to be variable with the aid of a cam control or a motor. During the transport of the respective signature 7, the speed of the delay element 36 and/or 36' from the angle position $\alpha_1$ to the angle position $\alpha_2$ is reduced with the aid of the aforementioned control and/or the motor. As a result, it is possible to further reduce the speed at which the signature 7 impacts with the stop element 10. FIG. 4 shows that the corresponding impact speed is substantially lower than the speed $v_2$. As mentioned above, such a speed delay can be achieved over several stages.

In FIG. 8, the curve K1 shows the course of the speed in a sheet feeder according to prior art where the signatures 7 hit the stop element 10 at the angle position $\alpha_3$ without being delayed. The signatures 7 are thus abruptly stopped with the speed $v_1$ of the gripper drum 13 when they reach the stop element 10 and/or are slowed to the peripheral speed $v_0$.

It will be understood that the above description of the present invention is susceptible to various modifications, changes and adaptations, and the same are intended to be comprehended within the meaning and range of equivalents of the appended claims.

What is claimed is:

1. A sheet feeder for supplying a conveying device with folded signatures from a stack of folded signatures, the sheet feeder comprising:

a gripper drum including at least one gripper to individually remove respective signatures from the stack;

a stopping device including a stop element peripherally positioned on the gripper drum to stop the signatures and to align the signatures with the fold of the signatures in a forward direction;

an opening device to open the individual signatures, to deposit the signatures on the conveying device, and to reverse the forward direction of the signatures;

a delay element including a surface moving in the same direction as the rotation of the gripper drum and at a conveying speed less than a speed of the gripper drum, the delay element further including at least one ring positioned concentric to the gripper drum; and a press-on device arranged upstream of the stop element to press the signatures released by the gripper against the delay element and to slow down the individual signatures upstream of the stop element to an approximate speed of the delay element prior to the signatures hitting the stop element.

2. The sheet feeder according to claim 1, wherein the press-on device is coupled to the stopping device.

3. The sheet feeder according to claim 1, wherein the surface of the delay element includes an outside surface and the press-on device includes at least one press wheel or a belt to press the respective signatures against the outside surface of the delay element.

4. The sheet feeder according to claim 1, wherein the press-on device includes a press wheel or pressing belt to press the signatures, respectively, against the delay element.

5. The sheet feeder according to claim 1, further comprising a drive to connect the delay element to the gripper drum.

6. The sheet feeder according to claim 1, wherein the delay element comprises two opposite-arranged rings, with outside surfaces.

7. The sheet feeder according to claim 1, wherein the delay element comprises at least one endlessly circulating belt.

8. The sheet feeder according to claim 7, wherein the endless belt includes a curved section in the region of the stopping device.

* * * * *